US006015172A

United States Patent [19]

Williams et al.

[11] Patent Number: 6,015,172

[45] Date of Patent: Jan. 18, 2000

[54] NECKTIE SUPPORT FOR TYING

[76] Inventors: Wayne Williams; Robert Todd Williams, both of 2712 The Plaza, Charlotte, N.C. 28205

[21] Appl. No.: 08/859,215

[22] Filed: May 20, 1997

[51] Int. Cl.[7] ..... A41D 25/08

[52] U.S. Cl. ..... 289/2; 289/1.5; 223/DIG. 1; 434/260

[58] Field of Search ..... 289/1.5, 2, 4, 17, 289/18.1; 2/144, 148, 152.1, 153, 154; 223/82, 85, 111, DIG. 1; 434/260

[56] References Cited

U.S. PATENT DOCUMENTS

| | | | |
|---|---|---|---|
| 1,367,461 | 2/1921 | Caumont | 2/153 |
| 2,972,749 | 2/1961 | Gruber | 2/153 |
| 3,307,864 | 3/1967 | Rosenzweig | 289/1.2 |
| 3,752,374 | 8/1973 | Pro | 223/111 |
| 5,577,778 | 11/1996 | Parietti et al. | 289/17 |
| 5,601,318 | 2/1997 | Rusing | 289/17 |
| 5,642,841 | 7/1997 | Beaty | 223/85 |
| 5,692,241 | 12/1997 | Helfer | 2/152.1 |

*Primary Examiner*—Michael A. Neas
*Attorney, Agent, or Firm*—Kennedy Covington Lobdell & Hickman, LLP

[57] ABSTRACT

A device for supporting a necktie during tying to facilitate the formation of a useful and aesthetically pleasing knot so that the necktie may be removed from the device and worn includes a base member, an arrangement for supporting a necktie including first and second support members mounted to the base member and projecting outwardly therefrom, and an arrangement for preventing necktie movement in a direction towards the first and second support members which is mounted to the base member at a vertical spacing from the upper support members. The present invention also provides a method for tying a necktie on the device which includes draping a necktie over the upper support members and, using the lower support members, forming a slip knot in the necktie which is drawn tight against the lower support member.

10 Claims, 15 Drawing Sheets

NECKTIE SUPPORT FOR TYING

BACKGROUND OF THE INVENTION

The present invention relates broadly to fixtures for supporting strands during knot tying and, more particularly, to a fixture or a device configured for tying with neckties wherein the necktie will be subsequently worn in public.

Men's neckties date back to the 1600s when Croatian soldiers wore silk handkerchiefs about their necks. Soon, the style spread to England and eventually to America where, today, a tie is considered a key element for business wear. In addition, certain women's fashions utilize neckties, but basically a necktie is a male adornment.

Some people wear ties more often than others, with businessmen wearing ties on almost a daily basis and other who are not in business wearing ties for special occasions. Further, as alluded to above, women may wear neckties but almost certainly wear neckties less than men.

For the occasional wearer, tying a necktie can be a troubling experience. Knot tying in general is not an easy task, yet it becomes easier with practice. The occasional wearer is therefore at a disadvantage due, basically, to a lack of experience in tying a necktie. This lack of experience can be especially troubling when the necktie must be tied under time pressure. Accordingly, any event requiring a necktie can be a troubling event to someone without experience in tying the necktie who must rush through a perhaps less than satisfactory effort in order to meet time demands. Other problematic areas involved with necktie knots occur with children's ties which must often be tied on a recalcitrant youngster.

Neckties generally have a wide portion, a narrow portion and a neck portion extending therebetween. Knots are formed by generally looping the wide portion around the narrow portion in a predetermined manner to form a slip knot. There are typically three types of knots in use today, namely the four-in-hand, the half Windsor and the full Windsor. Each provides a distinctive size and shape, and each may be distinguished by additional looping of the wide portion during knot formation.

It would be helpful under conditions as described above to have a fixture on which a necktie may be tied or knotted and then removed and donned by the ultimate wearer. This would allow those under time constraints to tie their necktie knot well in advance of the event in question and then have the tie available for wearing at the proper time. Such a device would also enhance the ability to tie a necktie intended for a child in advance. The tie may be tied off the child and later donned by the child for public wearing.

BRIEF SUMMARY OF THE INVENTION

It is accordingly an object of the present invention to provide a fixture or device on which a necktie may be tied in a manner which will allow the necktie to be subsequently worn in public.

It is another object of the present invention to provide a method for tying a necktie using such a fixture.

To these collective ends, a device for supporting a necktie during tying to facilitate the formation of a useful and aesthetically pleasing knot so that a necktie having a knot formed on the device may be removed from the device and worn includes a base member extending generally vertically, an assembly for supporting a necktie including first and second support members mounted to and projecting outwardly from the base member with the first support member being spaced a predetermined distance away from the second support member and an arrangement for preventing necktie movement in a direction toward the first and second support members mounted to the base member at a vertical spacing below the first and second support members and defining a knot forming region thereat.

Preferably, the first and second support members include first and second rods projecting generally perpendicularly outwardly from the base member in a generally parallel side-by-side relationship. Preferably, the first and second rods terminate in respective distal ends and the present invention further includes a curved member extending between the respective ends with the curved member including two generally vertically extending portions projecting upwardly from the distal ends and a generally horizontal member joined to the vertically extending portions and extending therebetween.

Preferably, the means for preventing necktie movement includes two generally S-shaped members projecting outwardly from the base member with each S-shaped member having a distal end and being mounted to the base member with the distal ends in closer proximity to one another than are locations where each of the S-shaped members joins the base. The present invention further preferably includes a generally U-shaped member extending between the distal ends associated with the S-shaped members. It is further preferred that the U-shaped member project generally vertically downwardly and away from the distal ends associated with the S-shaped members.

It is preferred that the present invention further include a plurality of necktie storage pegs mounted to and projecting outwardly from the base member.

The present invention also provides a method for tying a necktie using the device with the necktie being separated from the neck of the intended wearer and with the necktie being suitable for donning in a tied condition with the method including the steps of providing a device for supporting the necktie during tying having a base member extending generally vertically, an assembly for supporting a necktie including first and second support members mounted to and projecting outwardly from the base member with the first support member being spaced a predetermined distance away from the second support member and an arrangement for preventing necktie movement in a direction toward the first and second support members mounted to the base member at a vertical spacing below the first and second support members and defining a knot forming region thereat, and including two generally S-shaped members projecting outwardly from the base member with each S-shaped member having a distal end and being mounted to the base member with the distal ends in closer proximity to one another than are locations where each S-shaped member joins the base. The method further preferably includes the steps of providing a necktie for tying using the device with the necktie including a wide portion, a narrow portion and a neck portion extending therebetween, suspending a necktie from the first and second support members with the wide portion hanging from one of the support members and the narrow portion hanging from another of the support members and the neck portion extending intermediate the S-shaped members.

The method provides two versions, one for the four-in-hand and one for the half-Windsor. It will be appreciated by those skilled in the art that the full Windsor knot may be formed using the device in a manner similar to the method for forming a half-Windsor.

The method further includes the steps of directing the wide portion across the narrow portion then redirecting the wide portion behind the narrow portion with the wide portion extending intermediate the first support member and the S-shaped members, directing the wide portion through the knot forming region and upwardly and into a knot forming relationship with the narrow portion with the relationship being in accordance with a chosen knot to form a slip knot in the necktie and removing the necktie from the device for wearing.

Preferably, the step of directing the wide portion through the knot forming region and upwardly and into a knot forming relationship with the narrow portion, the relationship being in accordance with a chosen knot, to form a slip knot in the necktie includes forming a four-in-hand knot by directing the wide portion upwardly behind the narrow portion and then directing the wide portion downwardly through a loop formed by the wide portion then drawing up the knot by pulling downwardly on the wide portion while holding the narrow portion to draw a knot thusly formed against the S-shaped members in the knot forming region.

It is further preferred that the step of directing the wide portion through the knot forming region and upwardly and into a knot forming relationship with the narrow portion, the relationship being in accordance with a chosen knot to form a slip knot in the necktie, includes forming a half-Windsor knot and the method further includes the steps of directing the wide portion upwardly across the neck portion and then redirecting the wide portion downwardly behind the neck portion prior to directing the wide portion through the knot forming region, directing the wide portion upwardly behind the narrow portion and then redirecting the wide portion downwardly through a loop formed by the wide portion, then drawing the knot up by pulling downwardly on the wide portion while holding the narrow portion to draw a knot thusly formed against the S-shaped members in the knot forming region.

In order to form a full Windsor knot, the wide portion is directed into an additional loop around the narrow portion. The present invention offers no advantage in tying one knot in favor of the other. It is adaptable to tying all types of necktie slip knots. Further, the base member may be formed from wood having a furniture-like finish with the support members being formed from brass or some other attractive metal, although it will be appreciated by those skilled in the art that the present invention should not be limited in any way by the choice of materials.

By the above, the present invention provides a valuable aid to people inexperienced with necktie tying that will allow them to tie knots prior to wearing which are virtually indistinguishable from knots tied by the experienced necktie wearer.

DETAILED DESCRIPTION OF THE INVENTION

Figure 1:
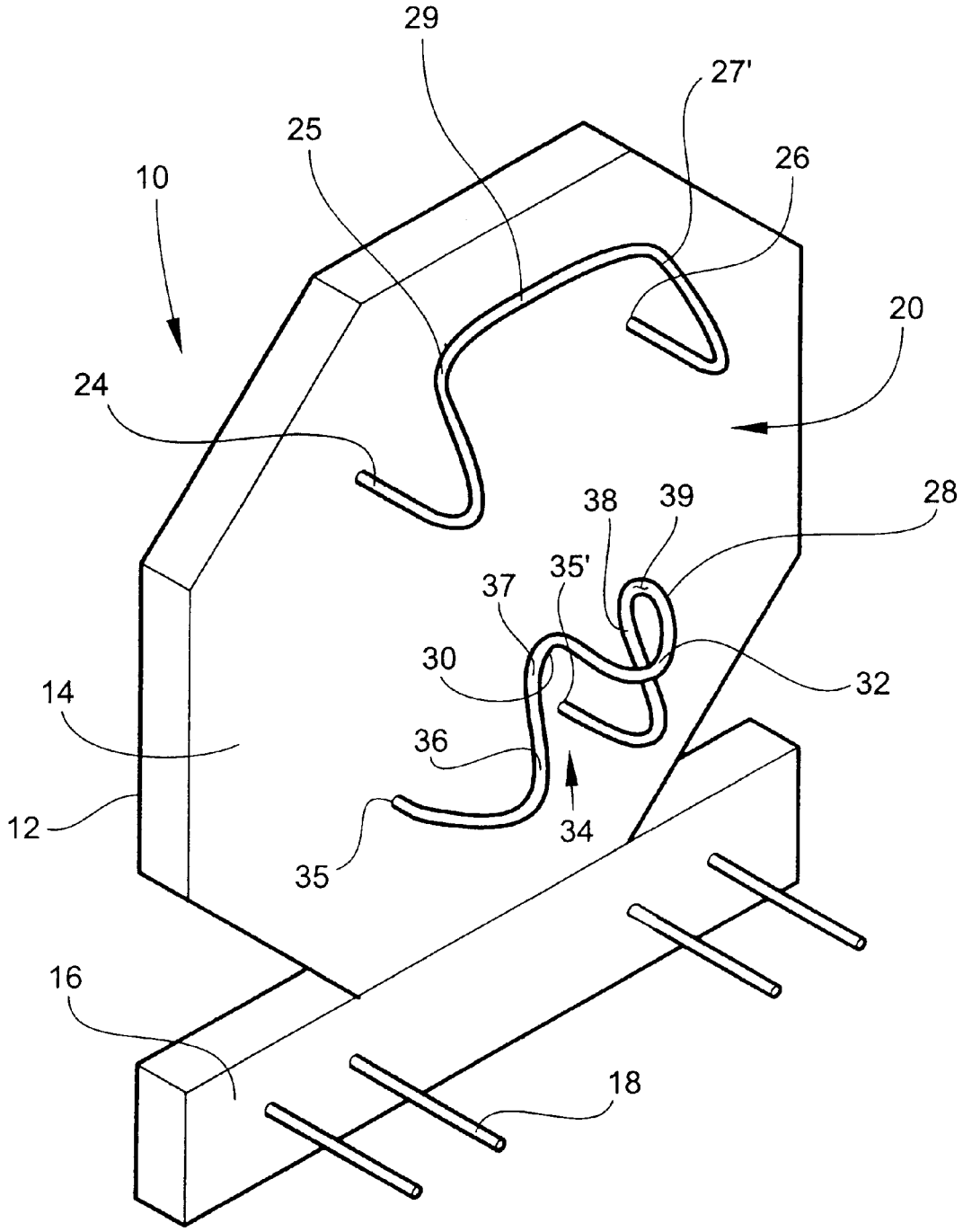
FIG. 1 is a perspective view of a device for supporting a necktie during tying according to the preferred embodiment of the present invention.

Turning now to the drawings and, more particularly to FIG. 1, a device for supporting a necktie during tying to facilitate the formation of a useful and aesthetically pleasing knot is illustrated generally at 10 and includes a generally planar base member 12 having an upper portion 14 which is illustrated as having an octagonal shape, yet it will be understood by those skilled in the art that the base member may take virtually any configuration so long as it will support the remaining structural features of the present invention. A generally rectangular lower portion 16 is attached to the lowermost portion of the upper portion 14. A plurality of generally cylindrical tie support rods projects outwardly from the lower portion 16. The entire device is configured for vertical disposition on a support structure, preferably a wall. The device 10 of the present invention may be formed from wood or any other suitable material.

A necktie support assembly 20 is attached to and projects outwardly from the upper portion 14 of the base member 12. The necktie support assembly includes a pair of upper support members 24,26 which are formed as generally cylindrical rods and project outwardly from the base 12 at a predetermined location in a generally parallel, side-by-side relationship. In the preferred embodiment, the upper support members 24,26 curve smoothly upwardly and are joined together with a connecting member 29. The connecting member 29 extends from a first distal end 25 of the first support member 24 to a second distal end 27 associated with the second support member 26. The upper support members 24,26 along with the connector 29 are integrally formed from a metallic material and curve smoothly from the first support member 24 to the second support member 26 with the connector 29 disposed rearwardly of the outermost extent of the first and second support members 24,26. It will be appreciated by those skilled in the art that the support members themselves may be individual members and not one continuous unit, yet the continuity of the upper support members provides a smooth surface for necktie support which will tend to eliminate any tendency a necktie would have to snag on a sharp surface. Further, while distal ends 25,27 are discussed, they are completely subsumed by the unitary nature of the first and second upper support members 24,26 and their connector 29. Nevertheless, it is not outside the scope of the present invention to eliminate the connector member 29 and utilize two hook-shaped members for the upper necktie support.

A lower support member 28 is provided which acts to define a knot tying region 34 and to prevent portions of the necktie from moving toward the upper support members 24,26. The lower support member 28 is formed as a unitary member in a manner similar to the upper support member and, accordingly, possesses the same non-snag features as the upper support members 24,26. The lower support member 28 includes two generally S-shaped member 36,38 which are mounted to the base member 12 at respective mounting locations 35,35' with the curvature of the S-shaped portions extending generally upwardly and inwardly toward one another. A generally U-shaped member 32 extends from the distal ends 37,39 of the S-shaped members 36,38 to join the S-shaped members 36,38 in a unitary manner. As discussed above with respect to the upper support members 24,26, the distal ends 37,39 of the S-shaped members 36,38 are completely subsumed by the unitary nature of the lower support member 28, but it will be understood by those skilled in the art that the present invention could retain its function if two S-shaped members were used without the joining U-shaped member 32. The U-shaped member 32 projects outwardly from the S-shaped members and downwardly slightly to cooperate with the S-shaped members 36,38 in defining a knot positioning surface 30 in the knot tying region 34 that is curved into a somewhat confining space to prevent the necktie from sliding out of place during knot formation.

The present invention is useful for tying virtually any type of necktie knot heretofore known and it is unlikely that any slip knots for neckties can be developed which will thwart the efforts of those who attempt to tie knots using the present invention. Further, the present invention is adaptable for practicing bow tie formation. Due to the length of bow ties, they are not adaptable for loosening to remove them from the device and slip them over the head of a potential wearer. Further, pretied bowties are available for those who lack the skill to successfully knot a bowtie. Nevertheless, such knots may be formed on the present invention and the present invention provides an excellent platform for those who wish to practice bowtie formation.

The method of the present invention is described herein with regard to the formation of four-in-hand knots and half-Windsor knots, but it will be understood by those skilled in the art that the formation of a full Windsor knot may be easily performed using the present invention.

Figure 2:
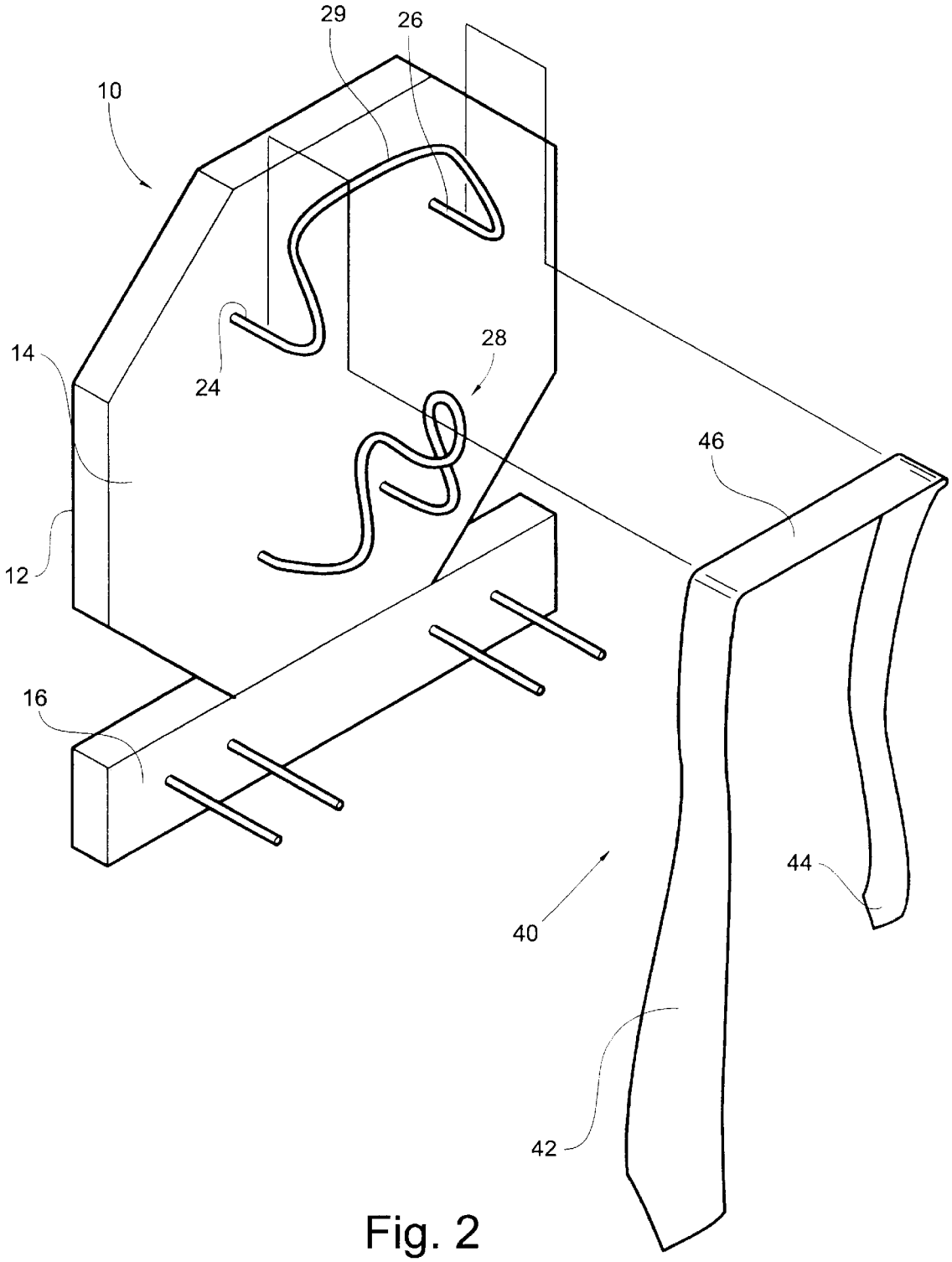
FIG. 2 is a perspective view of the device illustrated in FIG. 1 and further illustrating the first step of the method of the present invention.

With reference to FIG. 2, all adaptations of the method of the present invention begin with placing the necktie 40 on the upper support members 24,26, with a wide portion 42 of the necktie 40 hanging from one side and a narrow portion 44 of the necktie 40 hanging from the other side and with the neck portion 46 extending therebetween and extending between the upper support members 24,26. In order to tie the knot properly, the wide portion 42 of the necktie 40 descends a predetermined distance beyond the narrow portion 44 of the necktie 40. The distance that the wide portion 42 extends beyond the narrow portion 44 is not exact for every user but, since this determines the ultimate length of the tied necktie, the distance will vary with each user and should be empirically determined.

Figure 3:
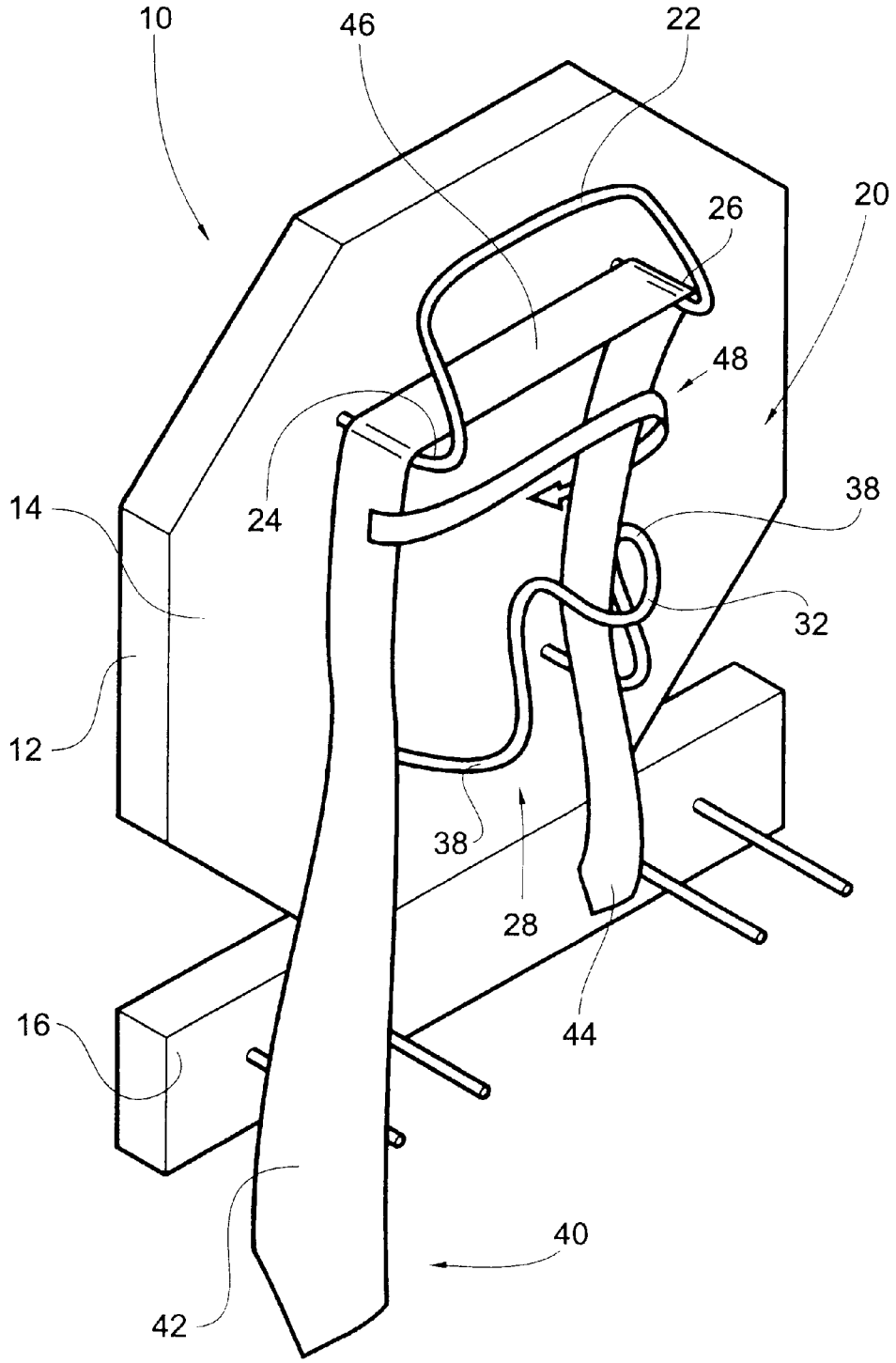
FIG. 3 is a perspective view of the device illustrated in FIG. 1 illustrating the second step of the method according to the present invention.
Figure 4:
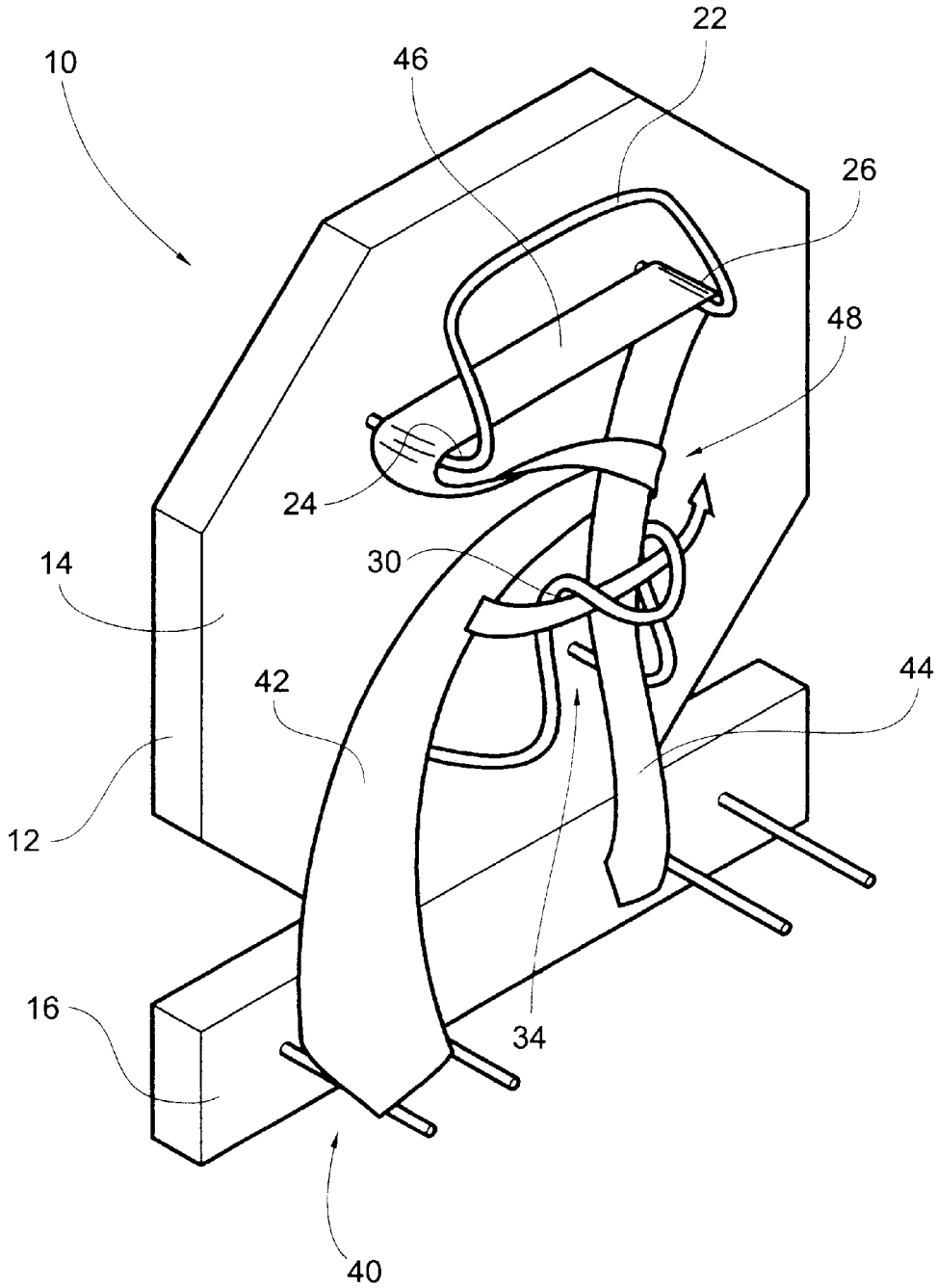
FIG. 4 is a perspective view of the device illustrated in FIG. 1 illustrating the third step and the method of the present invention.

When forming a four-in-hand knot, and with reference to FIG. 3, the next step of the method is to direct the narrow portion 44 to hang intermediate the S-shaped members 36,38 and behind the U-shaped portion 32 of the lower support member 28. Next, the wide portion is wrapped around the narrow portion at a position intermediate the upper support members 24,26 and the lower support member 28 to come across the narrow portion and turn back underneath, the turn being indicated at 48 and as indicated by an arrow in FIG. 3. The next step is to continue to draw the wide portion 42 around the narrow portion 44 and pass the wide portion 42 across the front of the narrow portion 44 once again with the wide portion 42 extending through the knot tying region 34 and in contact with the knot positioning surface 30, as indicated by an arrow in FIG. 4, with the first turn through the knot forming region indicated at 50 in FIG. 5.

Figure 5:
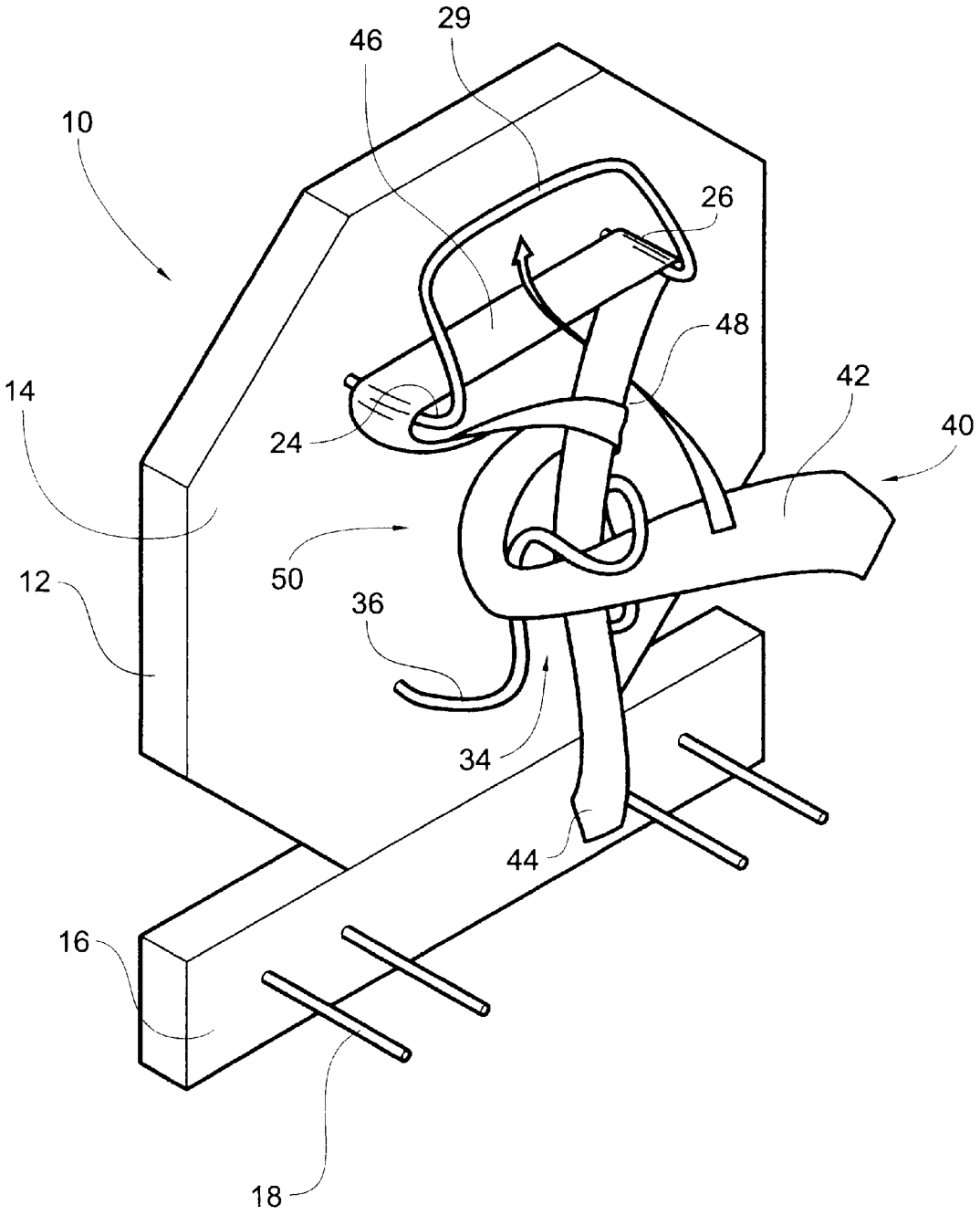
FIG. 5 is a perspective view of the device illustrated in FIG. 1 illustrating the fourth step in the method of forming a four-in-hand knot according to the present invention.
Figure 6:
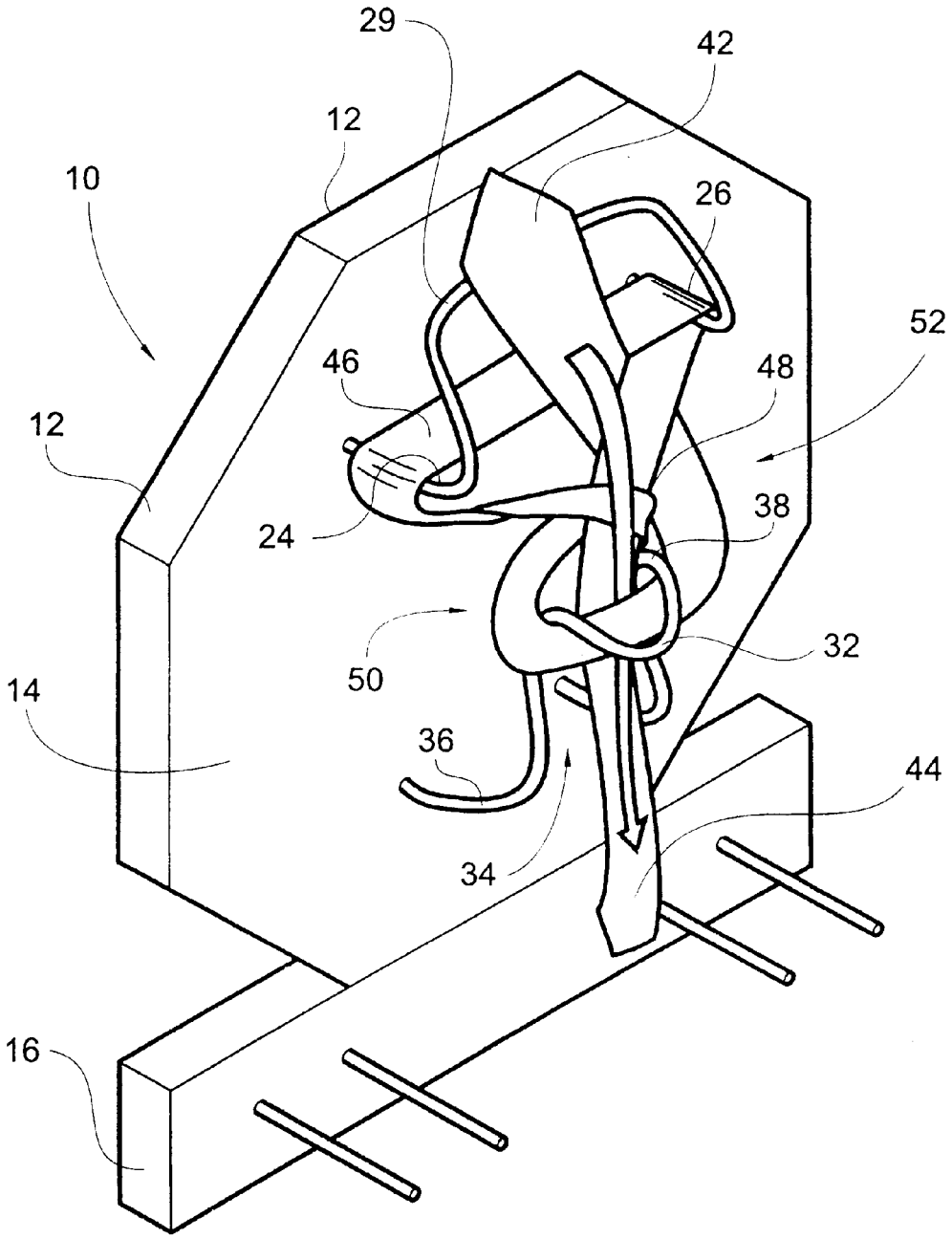
FIG. 6 is a perspective view of the device illustrated in FIG. 1 illustrating a subsequent step in forming a four-in-hand knot according to the method of the present invention.
Figure 7:
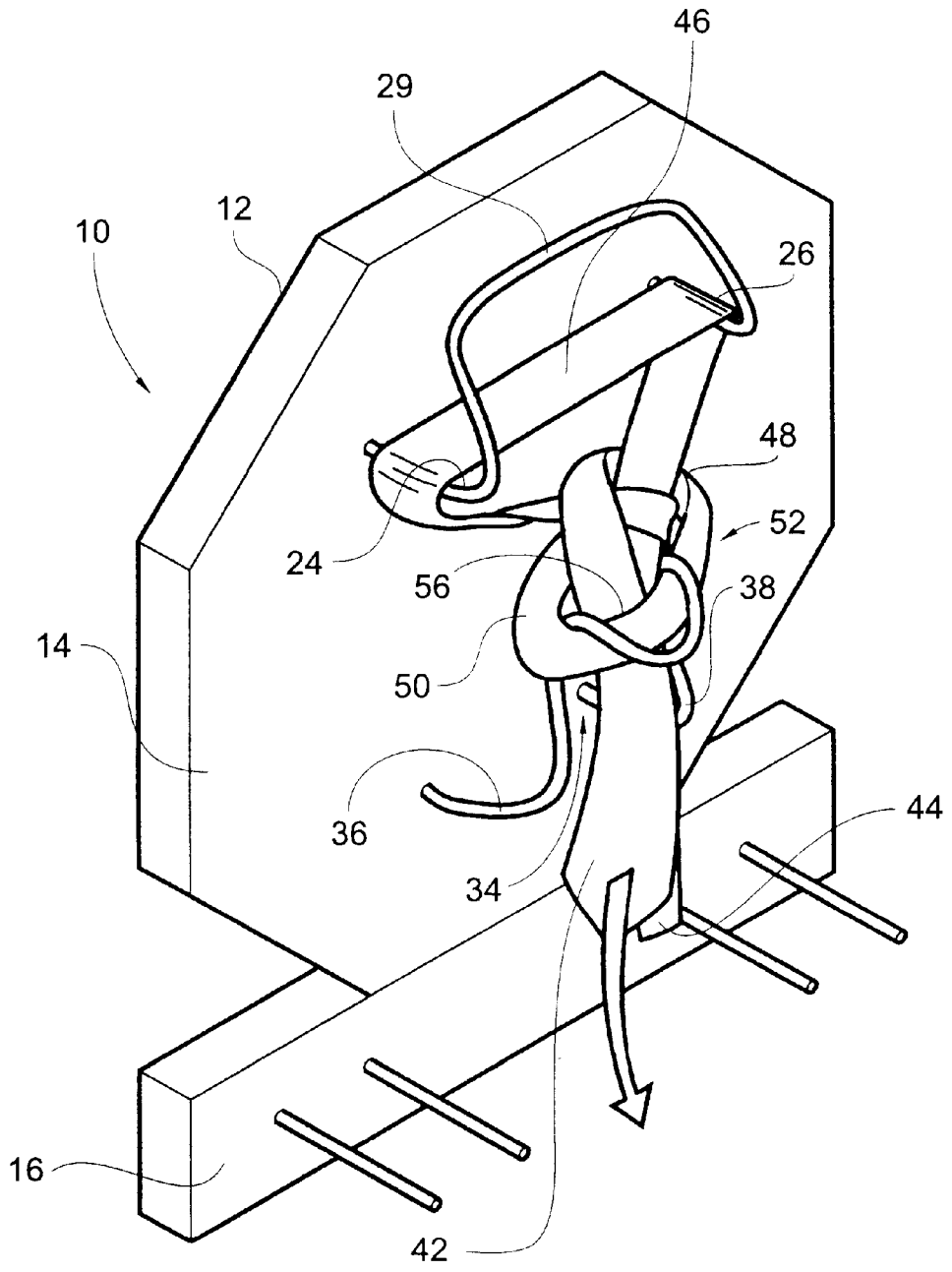
FIG. 7 is a perspective view of the device illustrated in FIG. 1 illustrating formation of a four-in-hand knot according to the method of the present invention.
Figure 8:
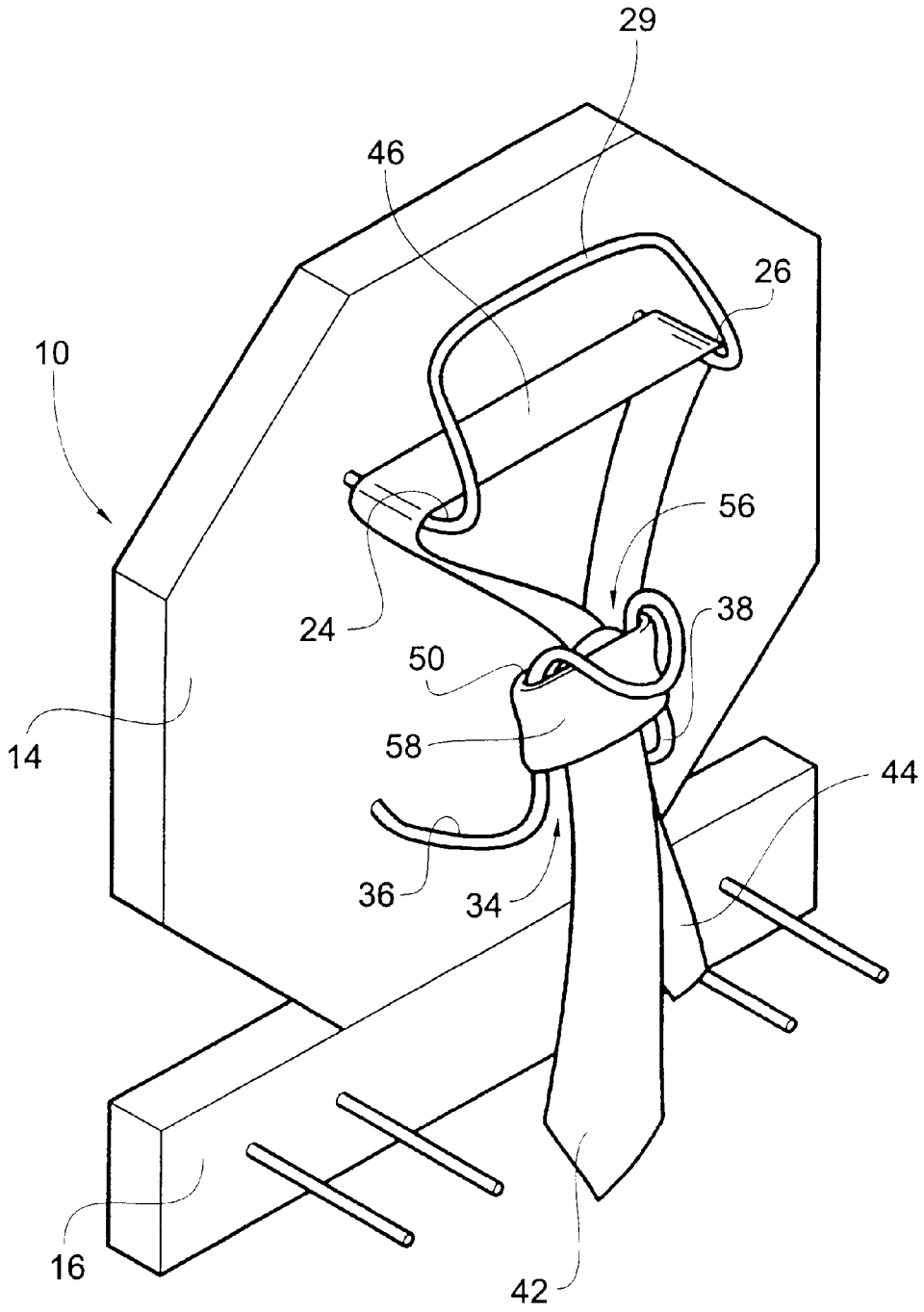
FIG. 8 is a perspective view of the device illustrated in FIG. 1 showing the final step in knot formation for a four-in-hand knot according to the method of the present invention.

At this stage of the method, indicated in FIG. 5, the wide portion 42 has been trained around the narrow portion at a first turn 48 and a second turn 50. Next, the wide portion 42 is passed upwardly through the loop formed adjacent the first turn 48, as indicated by an arrow in FIG. 5. This results with the wide portion 42 being trained through the knot tying region 34 and extending upwardly beyond the neck portion 46 which covers the distance between the two upper support members 24,26. The result of this maneuver is indicated in FIG. 6, with the up-turn indicated generally at 52. Next, the wide portion 42 is turned and directed downwardly through the loop thusly formed intermediate the second turn 50 and the up-turn 52 by the wide portion 42, as indicated by an arrow in FIG. 6. This also results in the wide portion 42 extending intermediate the two S-shaped members 36 and intermediate the base member 12 and the U-shaped portion 32. The result of this is seen in FIG. 7. There, the wide portion 42 extends downwardly intermediate the S-shaped members 36,38 and within the loop 56 formed by wrapping the S-shaped member from the first turn 48 through the second turn 50 through the up-turn 50 and finally downwardly intermediate the S-shaped members 36,38.

Figure 9:
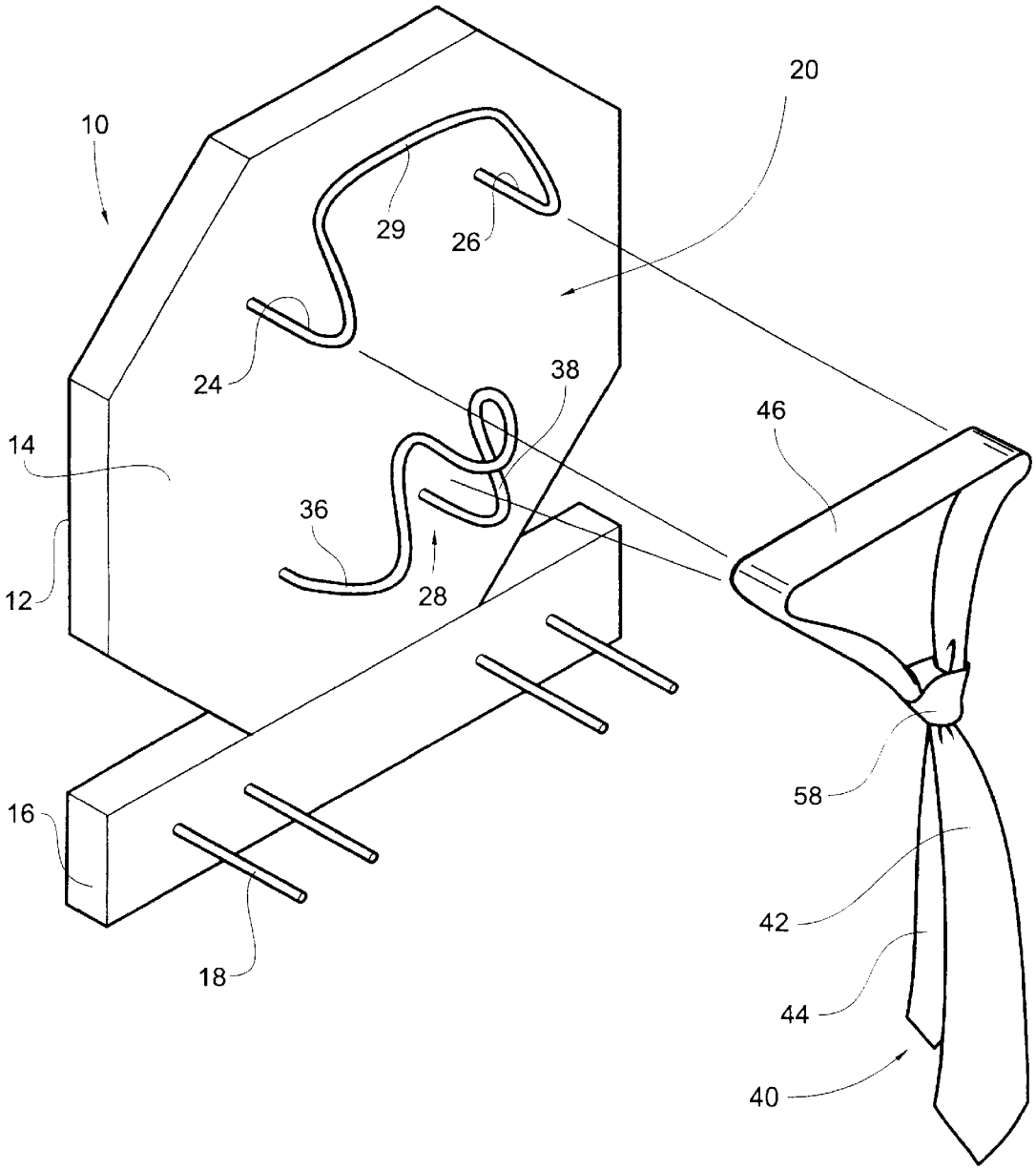
FIG. 9 is a perspective view of the device showing the final knotted necktie illustrating a four-in-hand knot according to the method of the present invention.

A slip knot has thusly been formed and it is tightened by holding the narrow end 44 while pulling the wide end 42, thus tightening the knot 58. As seen in FIG. 9, the necktie with a four-in-hand knot 58 formed therein is removed from the device 10 of the present invention by slightly loosening the knot 58 and slipping the tie over the lower support member 28 and the upper support members 24,26. Thus, the necktie 40 may then be slipped over the head of a user and drawn up tight for wearing in public.

Figure 10:
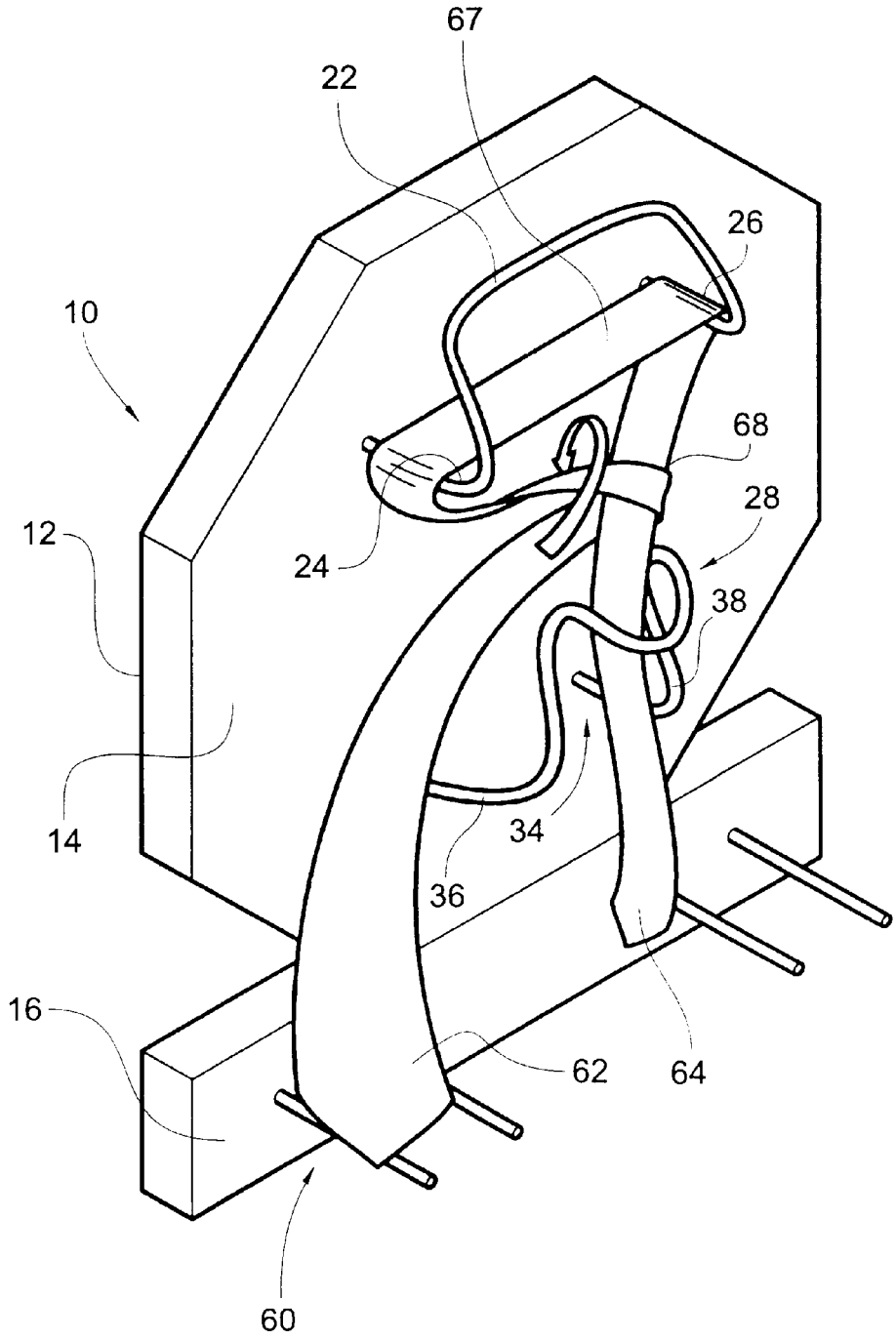
FIG. 10 is a perspective view of the device illustrated in FIG. 1 showing a subsequent method step for forming a half-Windsor knot according to the method of the present invention.
Figure 11:
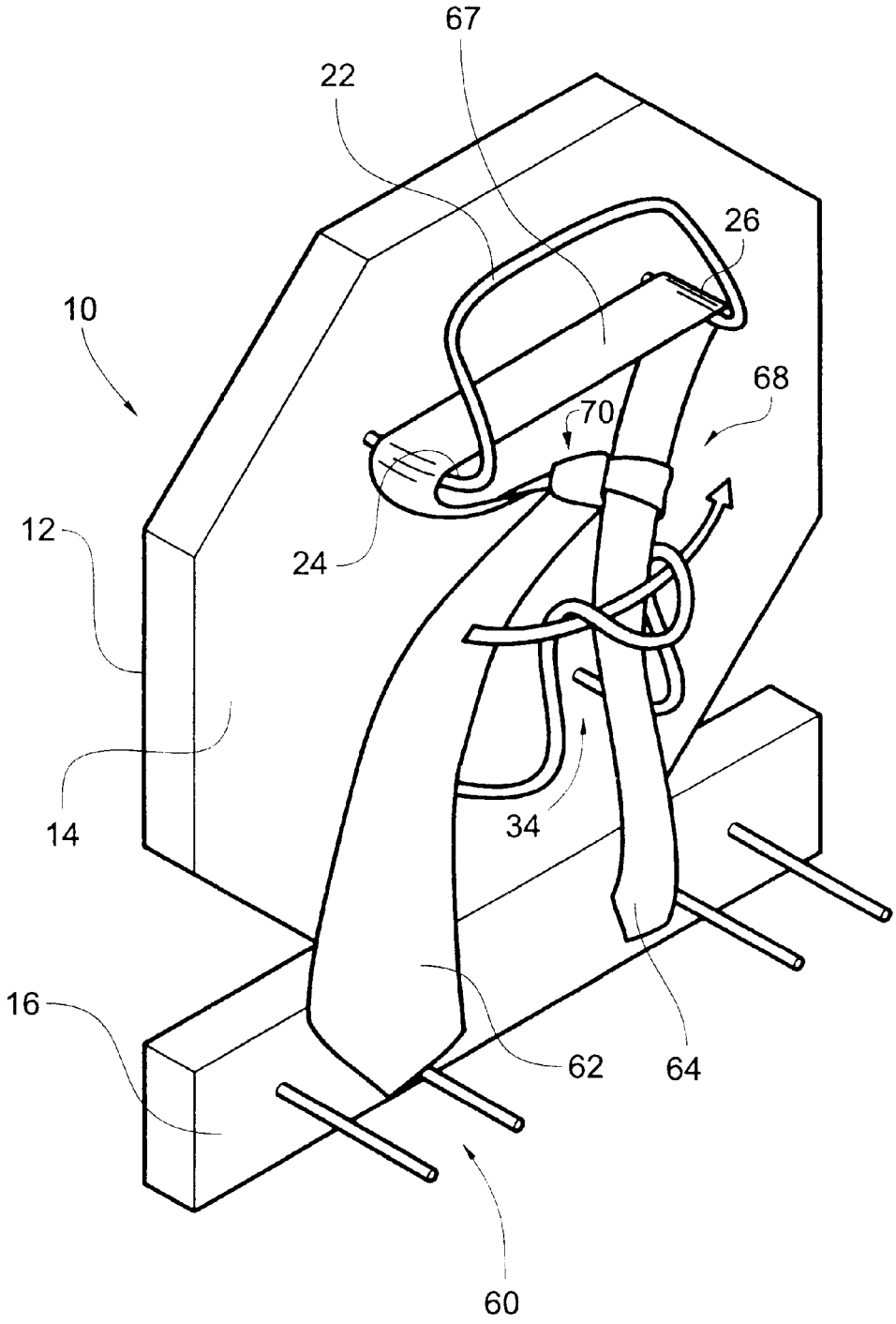
FIG. 11 is a perspective view of the device illustrated in FIG. 1 showing a subsequent method step in formation of a half-Windsor knot according to the method of the present invention.

According to another embodiment of the method of the present invention, a half-Windsor knot may be formed. Initially, a necktie 60 is positioned on the upper support members 24,26 as indicated in FIG. 2 using the previous necktie 40. Referring now to FIG. 10 the first step of half-Windsor knot formation includes directing a narrow portion 64 of the necktie to hang intermediate the S-shaped members 36,38 and descend through the knot tying region 34. The wide portion 62 of the necktie is wrapped around the narrow portion 64 at a first turn 68 to extend back underneath the narrow portion 64 and intermediate the upper support members 24,26 in the lower support member 28. Next, the wide portion 62 is turned upwardly and then downwardly through the loop previously formed, as indicated by an arrow in FIG. 10. The result of this action is illustrated in FIG. 11 with the loop-over illustrated at 70. This additional looping acts to distinguish the half-Windsor knot from the four-in-hand knot.

Figure 12:
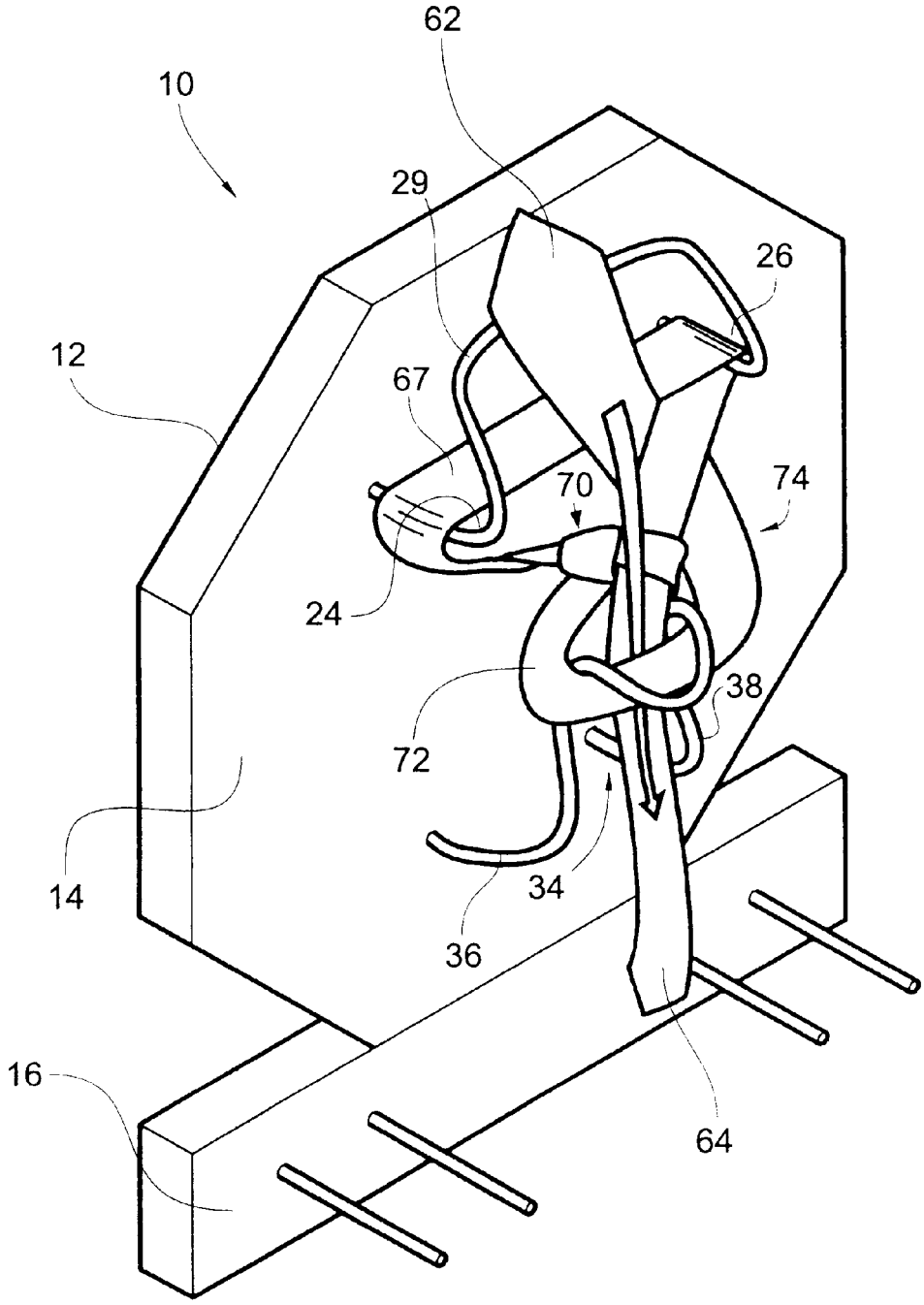
FIG. 12 is a perspective view of the device illustrated in FIG. 1 showing a subsequent step in forming a half-Windsor knot according to the method of the present invention.
Figure 13:
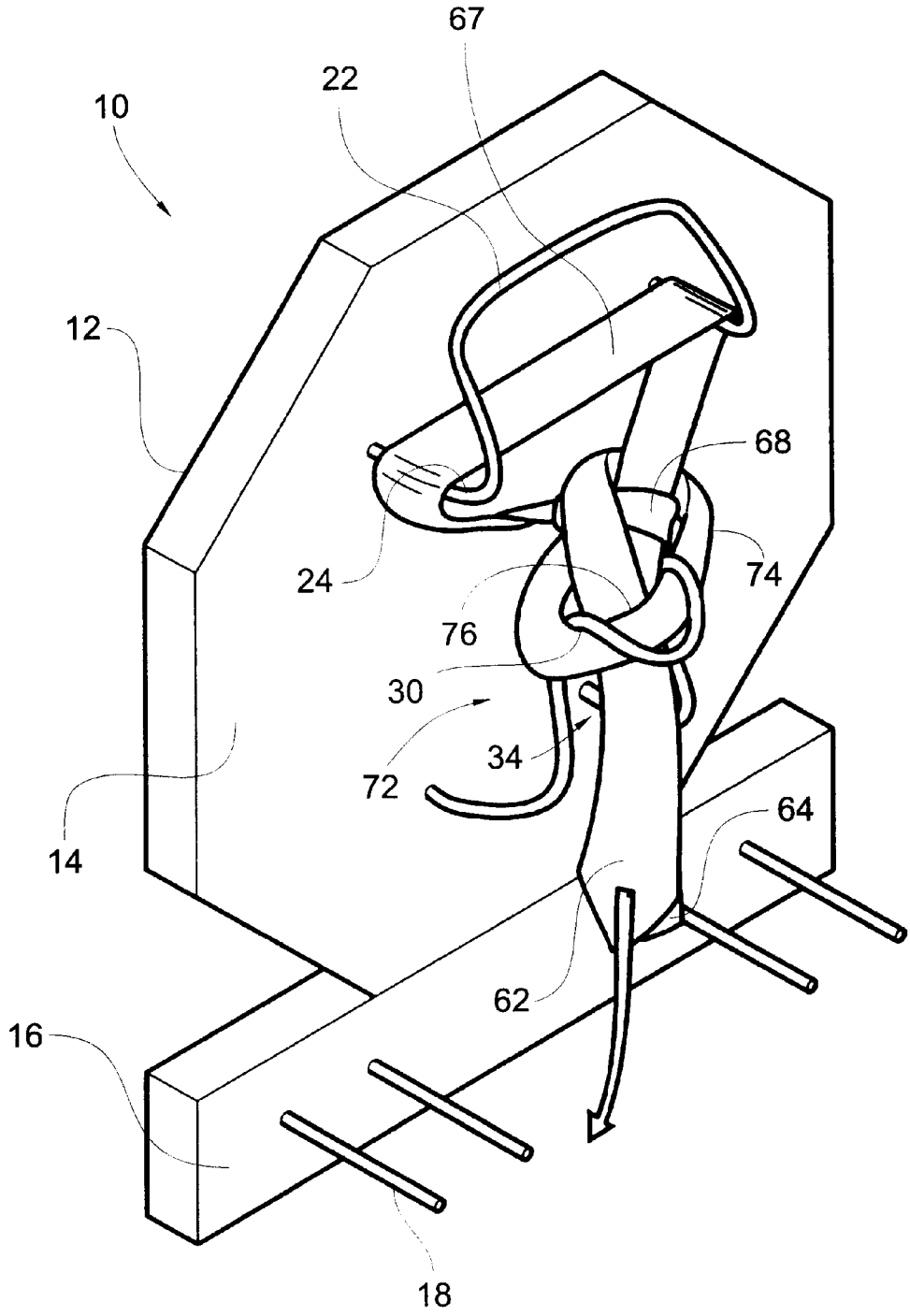
FIG. 13 is a perspective view of the device illustrated in FIG. 1 showing a subsequent step in forming a half-Windsor knot according to the method of the present invention.
Figure 14:
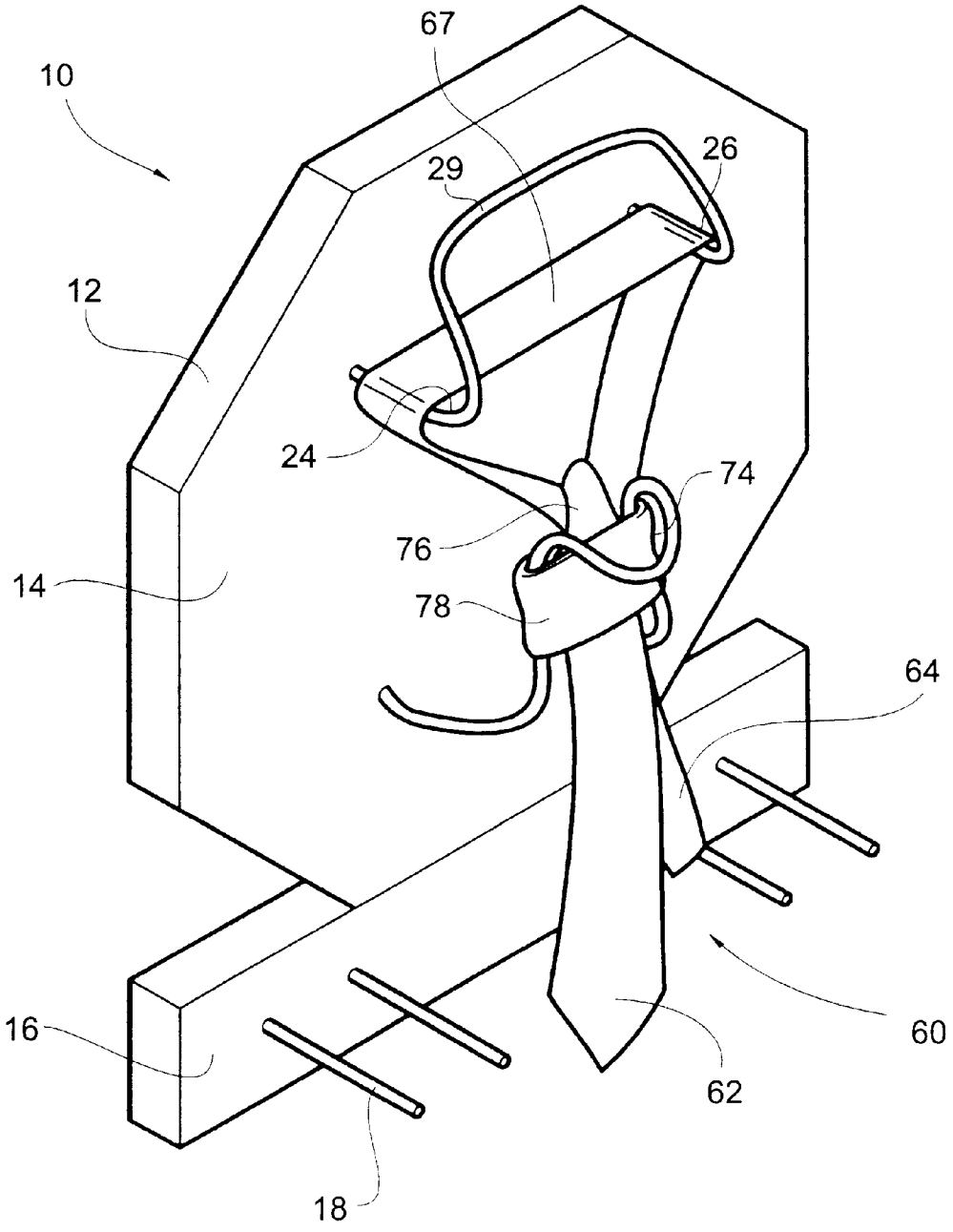
FIG. 14 is a perspective view of the device illustrated in FIG. 1 showing the knot formation step of a half-Windsor knot in accordance with the method of the present invention.
Figure 15:
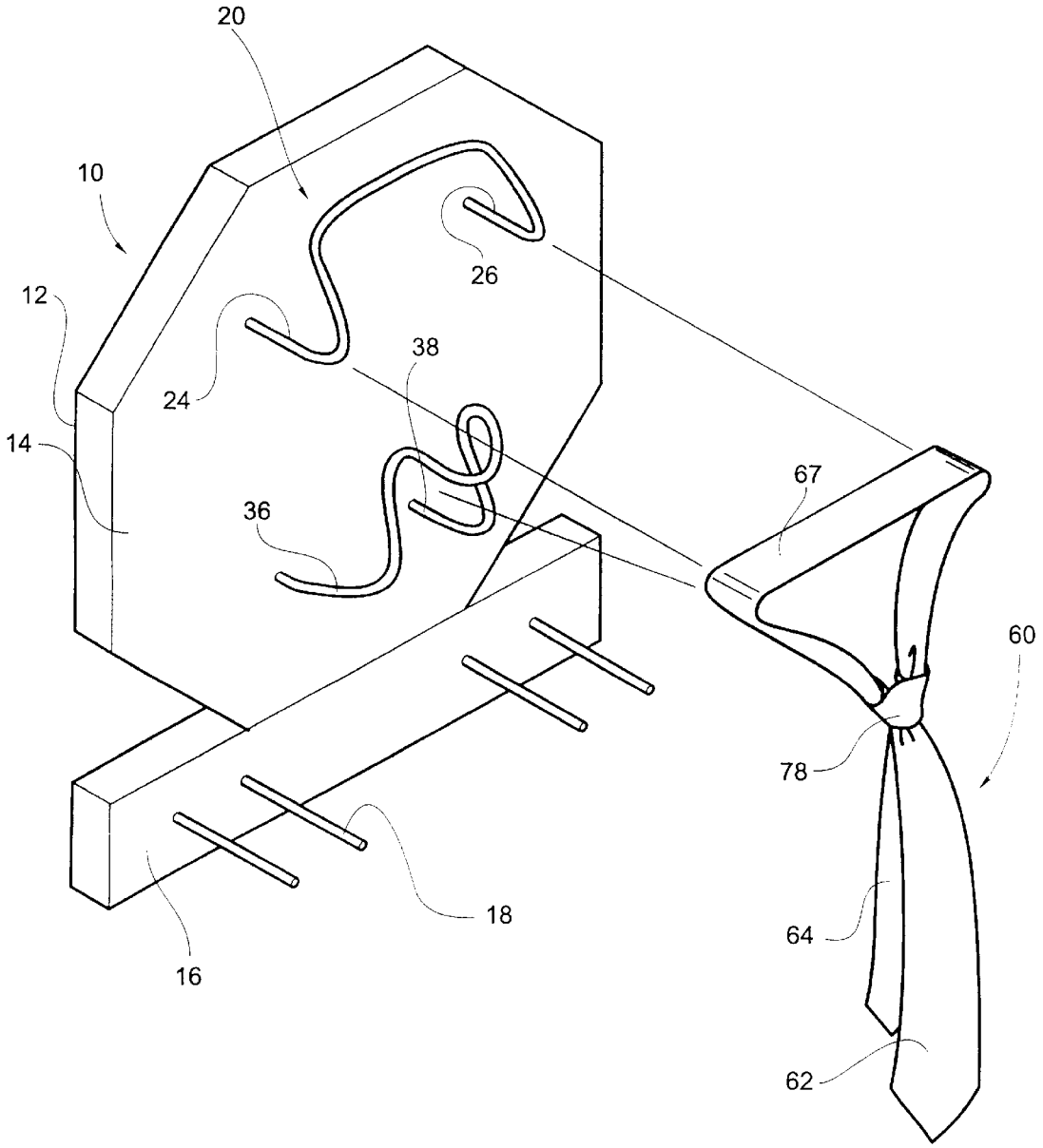
FIG. 15 is a perspective view of the device illustrated in FIG. 1 illustrating the half-Windsor knot formed according to the method of the present invention.

With continued reference to FIG. 11, the next step in half-Windsor knot formation includes directing the wide portion 62 through the knot tying region 34 in front of the narrow portion 64, as indicated in FIG. 11 by an arrow. Next, and with reference to FIG. 12, the wide portion 62 is upturned as indicated at 74 and directed intermediate the neck portion 67 and the narrow portion 64. The wide portion 62 is then directed downwardly intermediate the S-shaped members and intermediate the narrow portion 64 and that part of the wide portion 62 which extends to the knot tying region 34 to form the knot, as indicated by an arrow in FIG. 12. Turning now to FIG. 13, a loop 76 has been formed through the knot tying region 34 and the knot 78 is completed by drawing the wide portion 62 downwardly to tighten the knot 78 against the knot positioning surface 30. Turning now to FIG. 14, the half-Windsor knot 78 is thusly formed. As with the four-in-hand method, the necktie may be removed from the device, as seen in FIG. 15, in a manner previously described. The result of this operation is a necktie having a half-Windsor knot formed therein which can then be slipped over the head of a wearer for use.

The full Windsor variation on the half-Windsor adds an extra loop to the half-Windsor and results in a large symmetrical knot.

By the above, the present invention provides an apparatus and method for tying neckties without wearing the necktie until the necktie is tied. The device also provides a platform for practicing bow tie knots and allows those with children who must wear neckties to tie the necktie off of the child for later use.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A device for supporting a necktie during tying to facilitate the formation of a useful and aesthetically pleasing knot so that a necktie having a knot formed on said device may be removed from said device and worn, said device comprising:

a base member extending generally vertically;

means for supporting a necktie including first and second support members mounted to and projecting outwardly from said base member with said first support member being spaced a predetermined distance away from said second support member, said first and second support members including first and second rods projecting generally perpendicularly outwardly from said base member in a generally parallel side-by-side relationship with said first and second rods including generally vertically extending portions projecting upwardly and terminating in respective distal ends and a generally horizontal curved member extending between and joined with said respective distal ends of said first and second rods; and means for preventing necktie movement in a direction toward said first and second support members mounted to said base member at a vertical spacing below said first and second support members and defining a knot forming region thereat.

2. A device for supporting a necktie during tying according to claim 1 and further comprising a plurality of necktie storage pegs mounted to and projecting outwardly from said base member.

3. A device for supporting a necktie during tying to facilitate the formation of a useful and aesthetically pleasing knot so that a necktie having a knot formed on said device may be removed from said device and worn, said device comprising:

a base member extending generally vertically;

means for supporting a necktie including first and second support members mounted to and projecting outwardly from said base member with said first support member being spaced a predetermined distance away from said second support member; and means for preventing necktie movement in a direction toward said first and second support members mounted to said base member at a vertical spacing below said first and second support members and defining a knot forming region thereat, said means for preventing necktie movement including two generally S-shaped members projecting outwardly from said base member, with each S-shaped member having a distal end and being mounted to said base member with said distal ends in closer proximity to one another than are locations where each said S-shaped member joins said base.

4. A device for supporting a necktie during tying according to claim 3 and further comprising a generally U-shaped member extending between said distal ends associated with said S shaped members.

5. A device for supporting a necktie during tying according to claim 4 wherein said U-shaped member projects generally vertically downwardly and away from said distal ends associated with said S-shaped members.

6. A device for supporting a necktie during tying to facilitate the formation of a useful and aesthetically pleasing knot so that a necktie having a knot formed on said device may be removed from said device and worn, said device comprising:

a generally planar base member extending generally vertically;

means for supporting a necktie including first and second support rods mounted to and projecting generally perpendicularly outwardly from said base member in a generally parallel side-by-side relationship with said first support rod being spaced a predetermined distance away from said second support rod and wherein said first and second support rods include generally vertically extending portions projecting upwardly and terminating in respective distal ends and a generally horizontal curved member extending between and joined to said respective distal ends; and means for preventing necktie movement in a direction toward said first and second support rods mounted to said base member at a vertical spacing below said first and second support members and defining a knot forming region thereat including two generally S-shaped members projecting outwardly from said base member, with each S-shaped member having a distal end and being mounted to said base member with said distal ends in closer proximity to one another than are locations where each said S-shaped member joins said base, and a generally U-shaped member extending between said distal ends associated with said S-shaped members, wherein said U-shaped member projects generally vertically downwardly and away from said distal ends associated with said S-shaped members.

7. A device for supporting a necktie during tying according to claim 6 and further comprising a plurality of necktie storage pegs mounted to and projecting outwardly from said base member.

8. A method for tying a necktie with said necktie being separated from the neck of the intended wearer, with said necktie being suitable for donning in a tied condition, said method comprising the steps of:

providing a device for supporting a necktie during tying having a base member extending generally vertically, means for supporting a necktie including first and second support members mounted to and projecting outwardly from said base member with said first support member being spaced a predetermined distance away from said second support member, and means for preventing necktie movement in a direction toward said first and second support members mounted to said base member at a vertical spacing below said first and second support members and defining a knot forming region thereat, and including two generally S-shaped members projecting outwardly from said base member, with each S-shaped member having a distal end and being mounted to said base member with said distal ends in closer proximity to one another than are locations where each said S-shaped member joins said base;

providing a necktie for tying using said device, the necktie including a wide portion, a narrow portion and a neck portion extending therebetween;

suspending a necktie from said first and second support members with the wide portion hanging from one of said support members and the narrow portion hanging from another of said support members and said neck portion extending intermediate said S-shaped members;

directing said wide portion across said narrow portion, then redirecting the wide portion behind the narrow portion with the wide portion extending intermediate said first support member and said S-shaped members;

directing said wide portion through said knot forming region and upwardly and into a knot forming relationship with said narrow portion, said relationship being in accordance with a chosen knot, to form a slipknot in said necktie;

removing said tied necktie from said device for wearing.

9. A method for tying a necktie with said necktie being separated from the neck of the intended wearer according to claim 8 wherein said step of directing said wide portion through said knot forming region and upwardly and into a knot forming relationship with said narrow portion, said relationship being in accordance with a chosen knot, to form a slipknot in said necktie includes forming a four-in-hand knot by directing the wide portion upwardly behind the narrow portion, and then redirecting the wide portion downwardly through a loop formed by the wide portion, then drawing up the knot by pulling downwardly on the wide portion while holding the narrow portion to draw a knot thusly formed against said S-shaped members in said knot forming region.

10. A method for tying a necktie with said necktie being separated from the neck of the intended wearer according to claim 8 wherein said step of directing said wide portion through said knot forming region and upwardly and into a knot forming relationship with said narrow portion, said relationship being in accordance with a chosen knot, to form a slipknot in said necktie includes forming a half-Windsor knot and further comprising the steps of directing the wide portion upwardly across the neck portion and then redirecting the wide portion downwardly behind the neck portion prior to directing the wide portion through the knot forming region, directing the wide portion upwardly behind the narrow portion, and then redirecting the wide portion downwardly through a loop formed by the wide portion, then drawing up the knot by pulling downwardly on the wide portion while holding the narrow portion to draw a knot thusly formed against said S-shaped members in said knot forming region.

* * * * *